United States Patent [19]

Hensel

[11] Patent Number: 4,794,889

[45] Date of Patent: Jan. 3, 1989

[54] FUEL PUDDLE BLEED SHUT-OFF FOR FUEL INJECTED TWO CYCLE ENGINE

[75] Inventor: Robert J. Hensel, Oshkosh, Wis.

[73] Assignee: Brunswick Corporation, Skokie, Ill.

[21] Appl. No.: 180,046

[22] Filed: Apr. 11, 1988

[51] Int. Cl.[4] ..... F02B 33/04

[52] U.S. Cl. ..... 123/73 SC; 123/514

[58] Field of Search ..... 123/478, 512, 73 SC, 123/73 A, 73 PP

[56] References Cited

U.S. PATENT DOCUMENTS

| | | | |
|---|---|---|---|
| 4,280,465 | 7/1981 | Staerzl | 123/494 |
| 4,290,394 | 9/1981 | Frank et al. | 123/73 A |
| 4,461,260 | 7/1984 | Nonaka et al. | 123/73 A |
| 4,590,897 | 5/1986 | Hundertmark | 123/73 A |
| 4,699,109 | 10/1987 | Hensel | 123/458 |
| 4,702,202 | 10/1987 | Hensel et al. | 123/52 M |

FOREIGN PATENT DOCUMENTS

| | | | |
|---|---|---|---|
| 0181962 | 11/1982 | Japan | 123/514 |
| 0032937 | 2/1983 | Japan | 123/514 |

*Primary Examiner*—Charles J. Myhre
*Assistant Examiner*—David A. Okonsky
*Attorney, Agent, or Firm*—Andrus, Sceales, Starke & Sawall

[57] ABSTRACT

A marine fuel injection system for a two cycle crankcase compression internal combustion engine includes a puddled fuel return line (44) between the crankcase (16) and a vapor separator (33). A shut-off valve (50) in the puddled fuel return line (44) is closed at high engine speed to prevent the flow at a high rate of a substantially gaseous medium to the vapor separator, to prevent fuel foaming otherwise caused thereby in the vapor separator and which would pass through the vapor vent line (41) to the induction manifold (17), causing an over-rich condition at high engine speed. At low engine speed, the shut-off valve (50) is open, permitting flow of puddled fuel to the vapor separator, which flow is substantially more liquidic and at a lower rate.

4 Claims, 6 Drawing Sheets

FUEL PUDDLE BLEED SHUT-OFF FOR FUEL INJECTED TWO CYCLE ENGINE

BACKGROUND AND SUMMARY

The invention relates to a marine fuel system for a two cycle fuel injected engine, and more particularly to a system for removing and recirculating fuel puddles including heavy fuel ends from low points in the crankcase, and preventing high return air flow rates at high engine speed otherwise causing fuel foaming.

In two cycle internal combustion engines, at idle speed, heavy fuel ends condense on the walls of the crankcase and accumulate in the lowest part of the crankcase, i.e. form fuel puddles. Various systems are known for recirculating the puddled fuel back into the crankcase for subsequent combustion. For example, the puddled fuel in the crankcase of one of the cyclinders is pumped out during the combustion power stroke of the piston in that cylinder pressurizing that section of the crankcase, and the puddled fuel is supplied to the crankcase of another cylinder whose piston is in its charging stroke thus creating a vacuum drawing fuel into that section of the crankcase. In other systems, the puddled fuel is recirculated with the fresh incoming fuel.

In fuel injected engines, it is important to accurately control the quantity of fuel delivered to the engine through the fuel injectors. It is common to use a high pressure pump to supply fuel to the injectors, with a pressure regulator providing an essentially constant fuel pressure at the injector. Excess fuel, i.e. the amount over and above that required by the engine, is recirculated, usually through a vapor separator, back to the fuel pump.

It is known in the prior art to provide a puddled fuel return line from the crankcase to the vapor separator, where the excess puddled fuel is mixed with the incoming fuel and re-routed to the fuel injectors. A shortcoming of such system is that at high engine speed, substantially all the fluid passing through the puddled fuel return line from the crankcase is gaseous (air), and because of its high flow rate, it tends to cause foaming of the fuel in the vapor separator. This foamed fuel passes through the vapor vent line to the induction system, causing an over-rich condition.

In the present invention, a shut-off valve is provided in the puddled fuel return line from the crankcase. At low engine speed, the valve is open, allowing fluid flow from the crankcase to the vapor separator. At high engine speed, the valve is closed, stopping the otherwise gaseous flow. With no flow from the crankcase to the vapor separator through the puddled fuel return line, the fuel in the vapor separator remains liquid, allowing proper engine operation at high speed.

BRIEF DESCRIPTION OF THE DRAWINGS

FIGS. 3–9 illustrate throttle linkage in accordance with co-pending application Ser. No. 07/180,048 filed on even date herewith, entitled "FUEL INJECTED TWO CYCLE ENGINE WITH PROGRESSIVE THROTTLE LINKAGE FOR IMPROVED RESOLUTION OF THROTTLE POSITION SENSOR".

FIG. 3 shows a perspective view of an intake manifold and progressive throttle linkage for improved throttle position sensor resolution, and shows the throttle valves in a closed position.

FIG. 4 is a view like FIG. 3 and shows the lower set of throttle valves beginning to open.

FIG. 5 is a view like FIG. 4 and shows the lower set of throttle valves further open, and the upper set of throttle valves ready to begin opening.

FIG. 6 is a view like FIG. 5 and shows further opening of the lower set of throttle valves, and opening o the upper set of throttle valves.

FIG. 7 is a view like FIG. 6 and shows the lower and upper throttle valves fully open.

FIG. 8 is a view taken along line 8—8 of FIG. 3.

FIGS. 9A-E sequentially illustrate operation.

DETAILED DESCRIPTION

PRIOR ART

Figure 1:
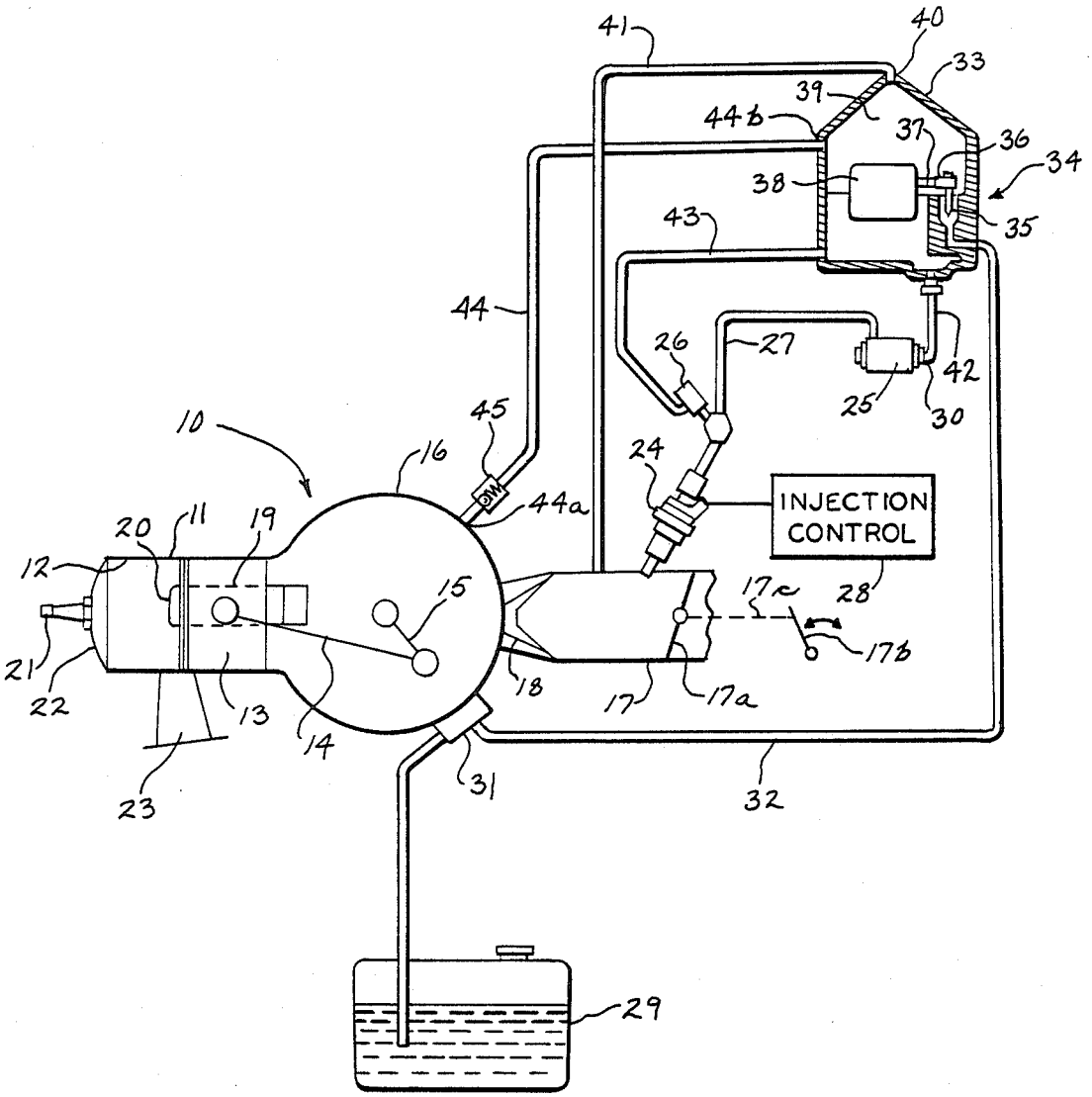
FIG. 1 PRIOR ART
FIG. 1 schematically illustrates a marine fuel system for a fuel injected engine, as known in the prior art.

FIG. 1 shows one cylinder of a two cycle crankcase compression internal combustion engine 10. The engine includes a cylinder block 11 having a cylinder bore 12 in which a piston 13 is supported for reciprocation. The piston 13 is connected by connecting rod 14 to crankshaft 15 which is journaled for rotation in crankcase 16 of engine 10. The engine includes an induction system with air intake manifold 17 having throttle valve **17*a* and supplying combustion air to crankcase 16. One-way reed check valve 18 permits flow from manifold 17 into crankcase 16, and prevents reverse flow out of crankcase 16 into manifold 17. A transfer passage 19 extends from crankcase 16 through cylinder block 11 and terminates at inlet port 20 in the cylinder wall at a point above the bottom dead center position of piston 13. A spark plug 21 is provided in the cylinder head 22 for firing the fuel-air charge. An exhaust port 23 is formed in cylinder bore 12** to discharge exhaust gases to the atmosphere.

Engine 10 is provided with a fuel injection system that includes an electromagnetically controlled injection nozzle 24 that discharges into induction manifold 17. Fuel, typically gasoline, is supplied to nozzle 24 by a high pressure fuel pump 25. A pressure regulator 26 is provided on the fuel supply line 27 to maintain an essentially constant fuel pressure at fuel injection nozzle 24. An electronic control 28 is provided to control the operation of injection nozzle 24 in known manner to deliver the desired amount of fuel to induction manifold 17 at the desired times.

During running of the engine, air is delivered to induction manifold 17 and fuel is injected by nozzle 24 to provide a fuel-air mixture which is admitted to crankcase 16 through reed valve 18 while piston 13 is moving upwardly toward spark plug 21. Reed valve 18 will open during these conditions as long as the pressure in crankcase 16 is lower than that in induction manifold 17. As piston 13 moves downwardly toward crankcase 16 exhaust port 23 will open to discharge spent combustion products, and intake port 20 will open to allow transfer of fuel-air mixture from crankcase 16 to cylinder 12. On the upstroke of piston 13, spark plug 21 is fired to ignite the mixture, and the cycle continues in conventional manner.

A vapor free supply of fuel from a remote fuel tank 29 is provided to the inlet 30 of high pressure fuel pump 25. A low pressure fuel pump 31, such as a diaphragm pump operated by the pulsating pressure in the engine's crankcase 16, is used to draw fuel from fuel tank 29. Such diaphragm pumps are commonly used on outboard motors and produce a fuel output closely matched to engine requirements. From the lower pressure pump 31 fuel is supplied by a fuel line 32 to a vapor separator 33. Admission of fuel from low pressure pump 31 to vapor separator 33 is controlled by a float operated valve 34. The valve member 35 is controlled by a lever 36 having a pivot point 37 fixed on the vapor separator 33 and attached to a float 38. The level of fuel in the vapor separator chamber 39 is thus controlled by the float operated valve 34. An opening 40 at the top of vapor separator chamber 39 is connected by a line 41 to induction manifold 17. The inlet 30 of high pressure fuel pump 25 is connected by fuel line 42 to draw fuel from the bottom of the vapor separator chamber 39. An excess fuel return line 43 from pressure regulator 26 returns excess fuel to the vapor separator chamber 39 for recirculation.

A puddled fuel return line 44 has an inlet **44*a* connected to a low point of crankcase 16 and has an outlet 44*b* connected to vapor separator 33. Other puddle return fuel lines are connected to vapor separator 33 from each crankcase section of the respective remaining cylinders of the engine for recirculation of puddled fuel including heavy fuel ends. During the combustion power stroke of piston 13 away from spark plug 21, the puddled fuel is pumped from crankcase 16 through one-way check valve 45 to vapor separator 33 for recirculation. Valve 45 prevents reverse flow through line 44 back into crankcase 16**.

In operation, low pressure fuel pump 31 supplies fuel to vapor separator 33 through float controlled valve 34. The pressure in vapor separator 33 at the surface of the fuel will be held at or below atmospheric pressure by the connection through line 41 to induction manifold 17. Thus, fuel which vaporizes will be drawn from separator 33 and supplied through line 41 to induction manifold 17. Hence, vapor free fuel will be supplied through line 42 to inlet 30 of high pressure fuel injection pump 25. Separator 33 is also effective to remove vapors from the excess fuel returned to separator 33 from pressure regulator 26 through excess fuel return line 43. Separator 33 is also effective to remove vapors from the puddled fuel returned to separator 33 from crankcase 16 through puddled fuel return line 44. Throttle **17*a* is controlled by operator actuated lever 17*b* through throttle linkage 17*c***.

PRESENT INVENTION

Figure 2:
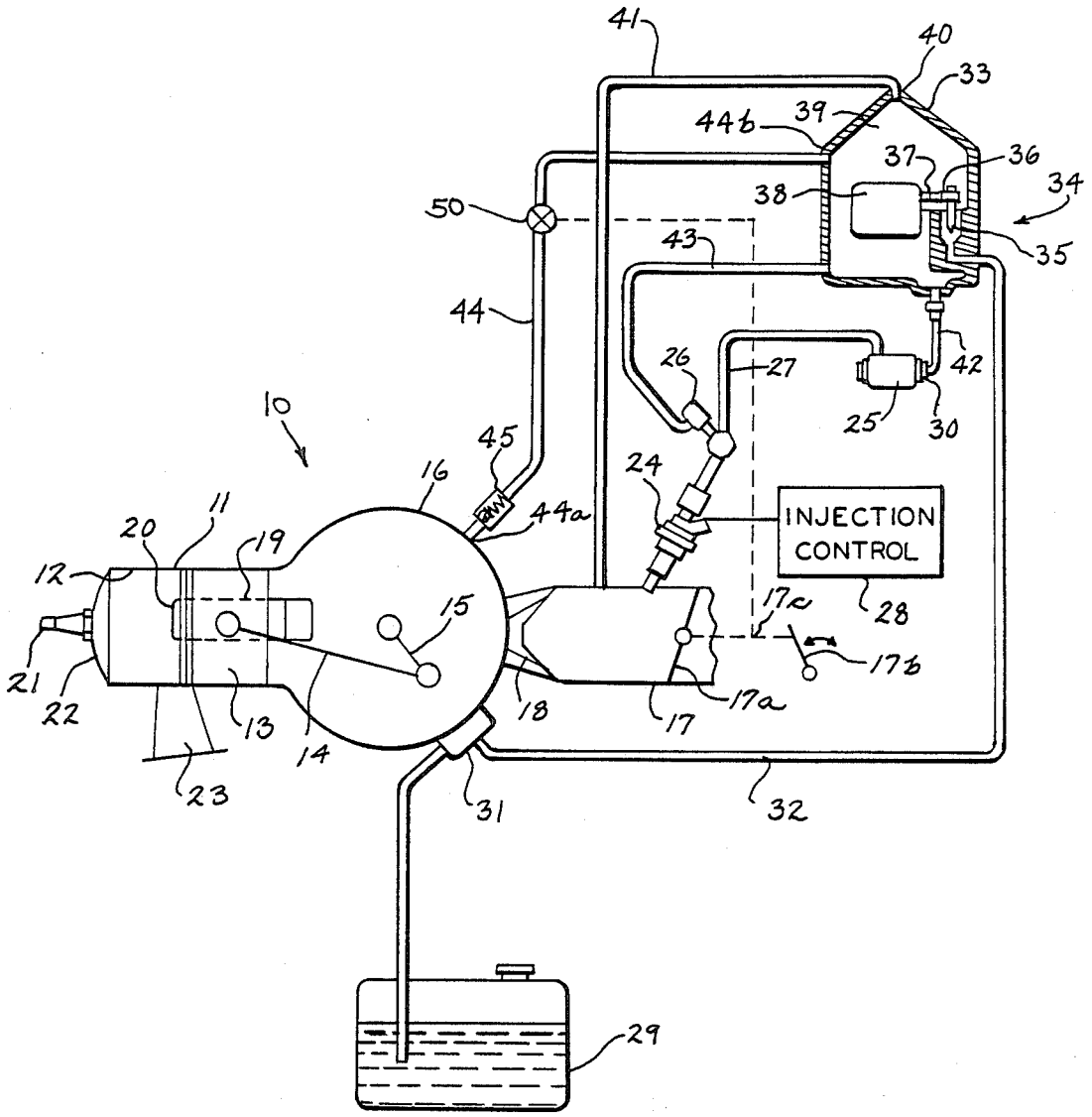
FIG. 2 shows a marine fuel system in accordance with the invention.

FIG. 2 shows a marine fuel system in accordance with the invention, and uses like reference numerals from FIG. 1 where appropriate to facilitate clarity. A shut-off valve 50, a Mercury Marine Part No. 20-18348, is provided in puddled fuel return line 44, and is controlled by throttle linkage **17*c* which also controls throttle 17*a*, and has a closed condition at high engine speed, and an open condition at low engine speed. At high engine speed, the high flow rate substantially gaseous flow is blocked from reaching the fuel system, to prevent fuel foaming in vapor separator 33, and hence prevent the passing of foamed fuel through vapor vent line 41 to induction manifold 17, otherwise causing an over-rich mixture. At low engine speed, the flow from the crankcase through puddled fuel return line 44 is substantially more liquidic and of a much lower rate, and is allowed to flow to vapor separator 33**.

The throttle control linkage is shown in FIGS. 3–9, and is the subject of co-pending application Ser. No. 07/180,048, filed on even date herewith, entitled "FUEL INJECTED TWO CYCLE ENGINE WITH PROGRESSIVE THROTTLE LINKAGE FOR IMPROVED RESOLUTION OF THROTTLE POSITION SENSOR".

Figure 3:
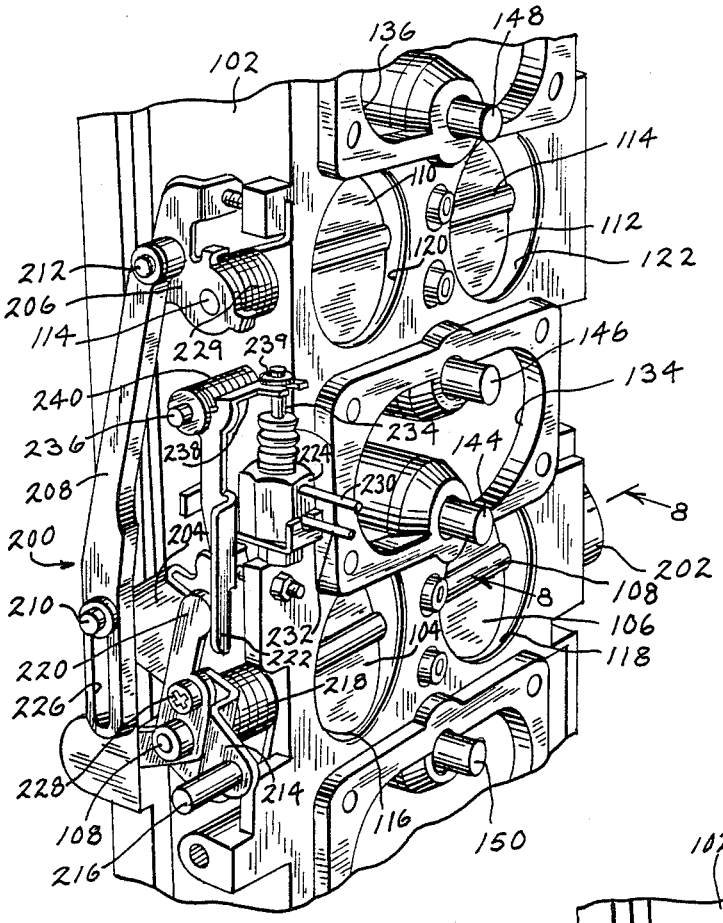

FIG. 3 shows an intake manifold 102, corresponding to manifold 22 in U.S. Pat. No. 4,702,202, incorporated herein by reference, for a two cycle crankcase compression fuel injected internal combustion engine having a plurality of reciprocal pistons connected to a crankshaft in a crankcase, for example as shown in incorporated U.S. Pat. No. 4,702,202 at engine 2 having pistons 4 connected to vertical crankshaft 6 in crankcase 8. Manifold 102 has a lower set of throttle valve plates 104, 106 mounted to lower pivot shaft 108 which is rotatably journaled to the manifold, and also has an upper set of throttle valve plates 110, 112 mounted to pivot shaft 114 which is rotatably journaled to the manifold. Throttle valves 104, 106, 110, 112 control the flow of combustion air through respective throttle bore passages 116, 118, 120, 122. In U.S. Pat. No. 4,702,202, the throttle valves are shown at 40, and the throttle bore passages are shown at 30.

Intake manifold 102 is mounted by an adapter plate, as shown at 24 in U.S. Pat. No. 4,702,202, to the engine crankcase, on the left in the orientation of FIG. 3, which adapter plate spaces the manifold away from the crankcase by a gap as shown at 26 in U.S. Pat. No. 4,702,202 providing a passage defining an intake flow path laterally behind the manifold and adjacent the crankcase, i.e. between the manifold and crankcase as shown at air flow path 28 in FIG. 6 of U.S. Pat. No. 4,702,202. Intake combustion air then flows in a second direction away from the crankcase and rightwardly through throttle bores 116, 118, 120, 122 in FIG. 7 in the present application at air flow path arrows 124, 126, 128, 130, FIG. 7, and as shown at air flow path 32 in U.S. Pat. No. 4,702,202. The intake combustion air flowing rightwardly in present FIG. 7 flows into a common plenum as shown at 42 in U.S. Pat. No. 4,702,202 provided by cover plate 60. The intake combustion air then flows in a third direction leftwardly in FIG. 7 through manifold passages 132, 134, 136 as shown at air flow paths 138, 140, 142, int the crankcase through the reed valves as shown at 10 in U.S. Pat. No. 4,702,202. Fuel injectors 144, 146 are mounted in passage 134, and in like manner a pair of fuel injectors are mounted in the other passages, one of which fuel injectors 148 is shown in passage 136, and one of which fuel injectors 150 is shown in passage 132. These fuel injectors are shown at 38 at U.S. Pat. No. 4,702,202. The fuel injectors inject fuel into the air flowing leftwardly through respective passages 132, 134, 136 to provide a fuel-air mixture into the crankcase. As noted in U.S. Pat. No. 4,702,202, for the V-6 engine shown, six fuel injectors are provided, one for each piston, and three supply passages 132, 134, 136 are provided, each having two fuel injectors. Four throttle bore passages 116, 118, 120, 122 are provided, each with a butterfly control valve 104, 106, 110, 112, respectively. Throttle bore passages 116, 118, 120, 122 and supply passages 132, 134, 136 interface at the common plenum 42 shown in U.S. Pat. No. 4,702,202 supplying combustion air for all the pistons.

FIG. 3 shows progressive throttle linkage 200 coupled to the lower set of throttle valves 104, 106 and to the upper set of throttle valves 110, 112 and movable to open the lower set of throttle valves through a given range of motion prior to opening the upper set of throttle valves. A throttle position sensor 202, Mercury Marine Part No. 148151, and for example U.S. Pat. No. 4,280,465, incorporated herein by reference, is mounted to manifold 102 and senses rotation of throttle pivot shaft 108 to in turn control fuel injection through the control circuitry, as in incorporated U.S. Pat. No. 4,280,465. Fuel injection pulse width is controlled according to sensed throttle position. During the initial range of motion of the throttle linkage, combustion air flows only through the lower set of throttle valves 104, 106, and not through the upper set of throttle valves 110, 112. This provides increases resolution of sensed throttle position at low engine speed because greater movement of the lower set of throttle valve plates 104, 106 is needed to obtain a given amount of combustion air flow for a given engine speed, all prior to opening the upper set of throttle valve plates 110, 112. This provides more accurate fuel injection.

Linkage 200 includes a lower lever arm 204 extending from throttle pivot shaft 108, and an upper lever arm 206 extending from throttle pivot shaft 114. A link 208 is connected between lever arms 204 and 206 by respective trunnions 210 and 212 extending from such lever arms. Lever arm 204 has a separate nonintegral arm 214 mounted on pivot shaft 108 and having a trunnion 216 to which an operator controlled cable linkage (not shown) is connected for pivoting lever arm 204 counterclockwise about pivot shaft 108. Lever arm 204 has an integral auxiliary arm 220 extending from lever arm 204 at pivot shaft 108. Auxiliary arm 220 has a slightly elongated slot 225, FIG. 9A, through which adjusting screw 228 extends into a threaded hole in arm 214, such that when screw 228 is loosened, arm 214 may be slightly rotated about pivot 108, without moving lever arm 204 and its integral auxiliary arm 220, to adjust the relative position of trunnion 216. Spring 218 biases lever arm 204 to a clockwise pivoted position with auxiliary arm 220 stopped against actuating arm 222 of a shut-off valve 224, to be described.

Figure 4:
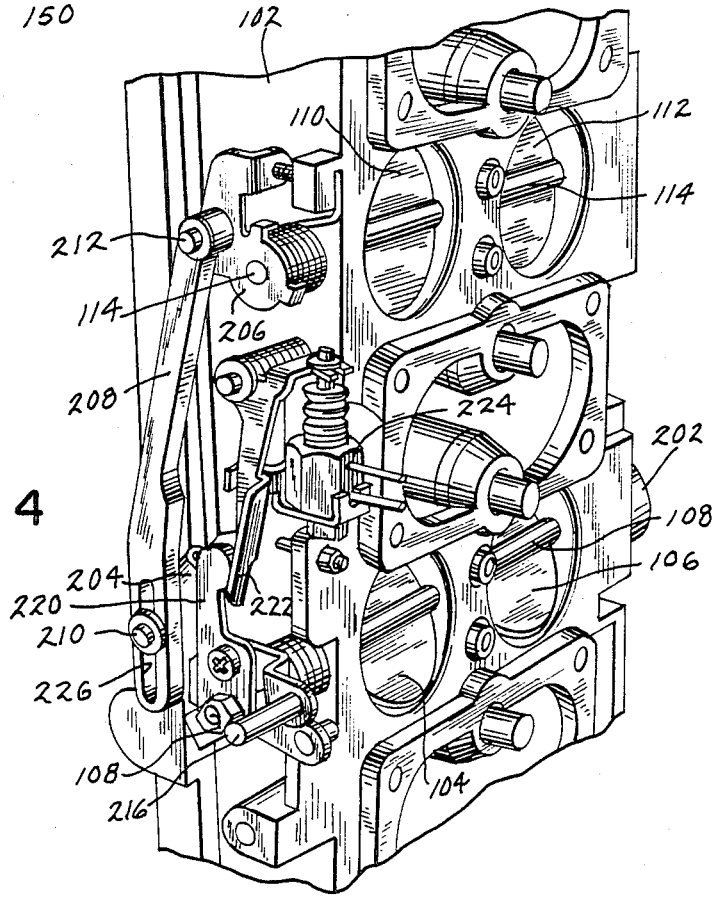
Figure 5:
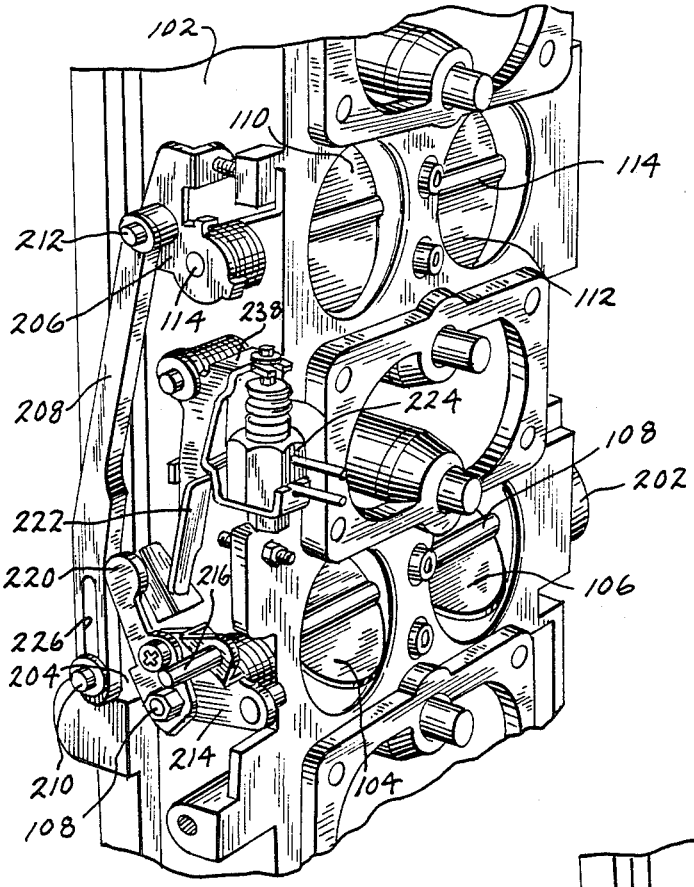
Figures 9A, 9B, 9C, 9D, 9E:
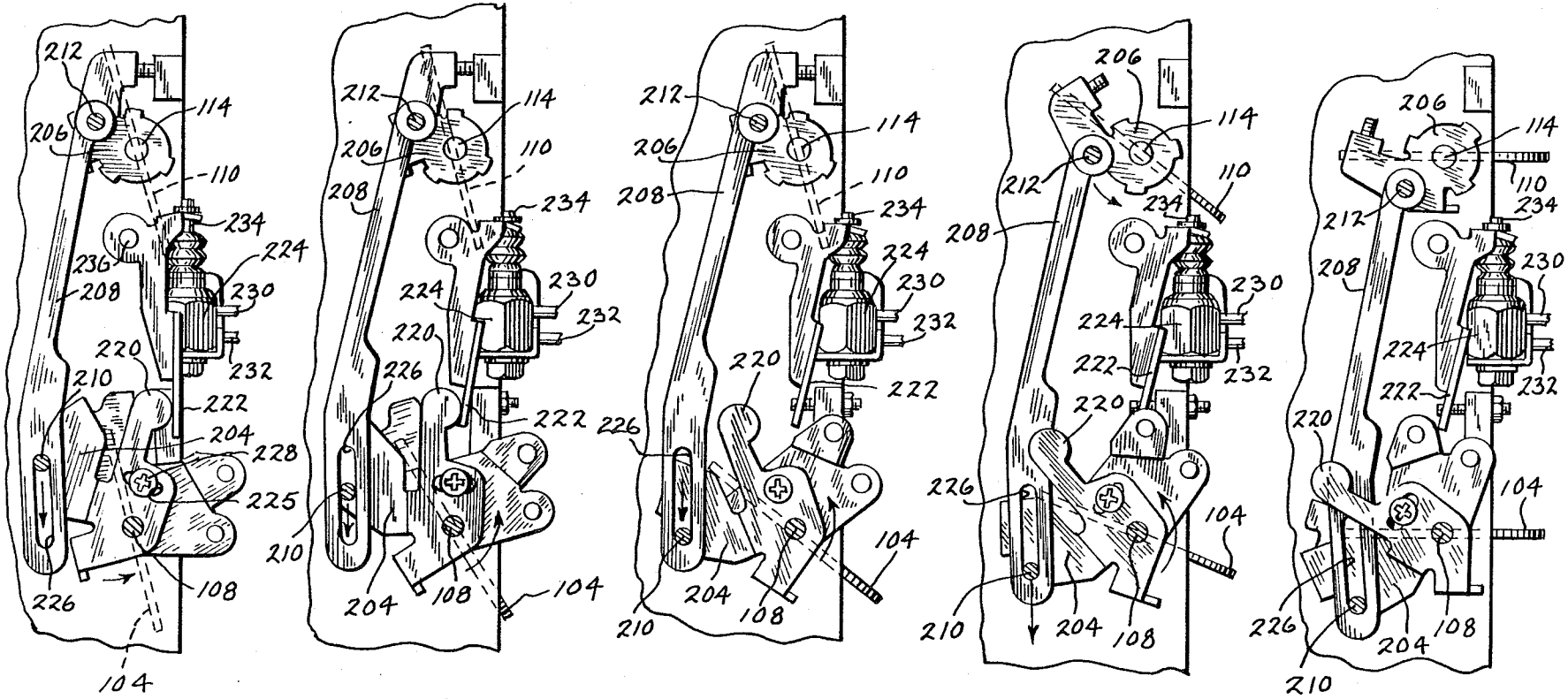
FIG. 9A is a side view of the structure of FIG. 3.
FIG. 9B is a side view of the structure of FIG. 4.
FIG. 9C is a side view of the structure of FIG. 5.
FIG. 9D is a side view of the structure of FIG. 6.
FIG. 9E is a side view of the structure of FIG. 7.

In operation, when lower lever arm 204 is pivoted counterclockwise about shaft 108 by pulling upwardly on trunnion 216, trunnion 210 at the end of lever arm 204 slides downwardly through lost motion elongated slot 226 in link 208, as shown in FIGS. 4 and 9B. During this motion, lower throttle valve plates 104, 106 begin to open, as shown by their slight counterclockwise rotation in FIGS. 4 and 9B. Upon further counterclockwise pivoting of lower lever arm 204, trunnion 210 moves further downwardly in slot 226 to the bottom end of such slot, as shown in FIGS. 5 and 9C. Lower throttle valve plates 104, 106 have now opened further, as shown in FIGS. 5 and 9C, but upper throttle valve plates 110, 112 have not yet opened. At the sequence stage shown in FIGS. 5 and 9C, the lost motion in slot 226 has been taken up by the downward movement of trunnion 210, and upper throttle valve plates 110, 112 are now ready to open.

Figure 6:
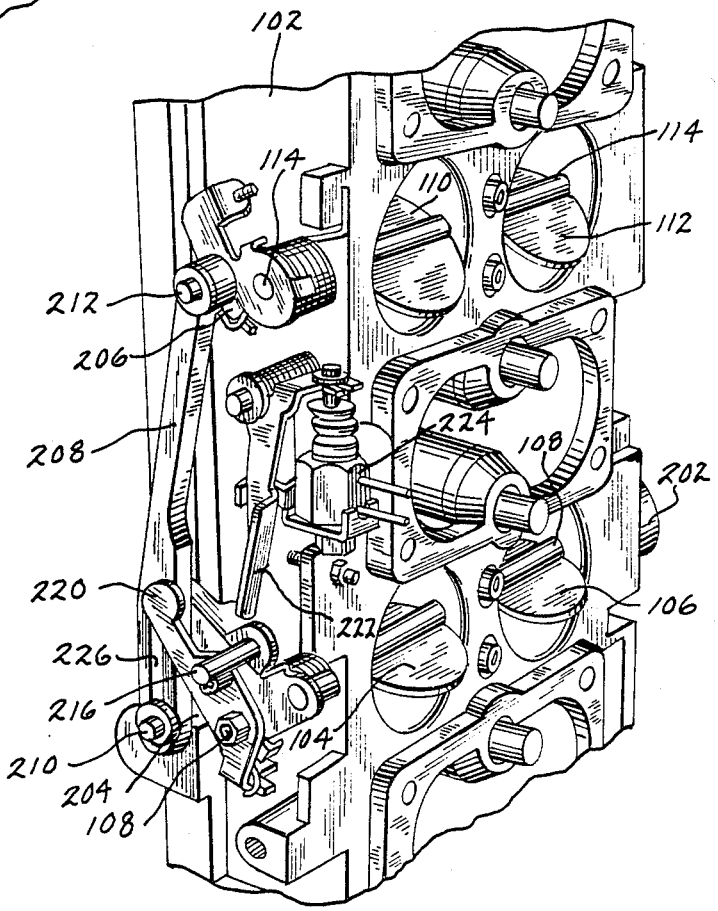
Figure 7:
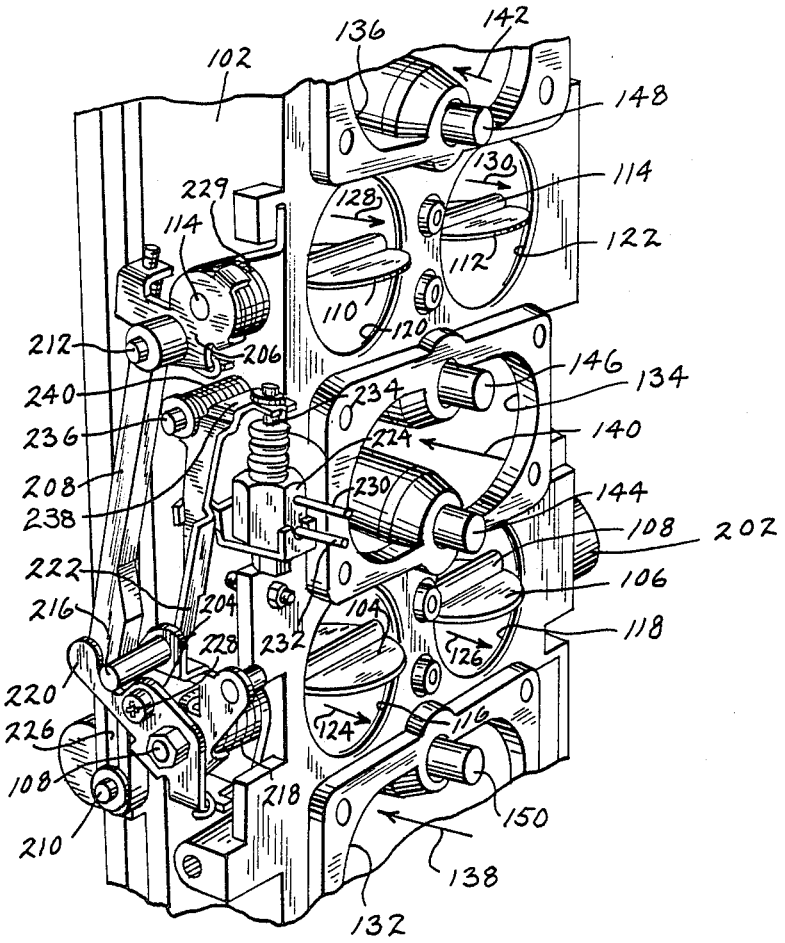
Figure 8:
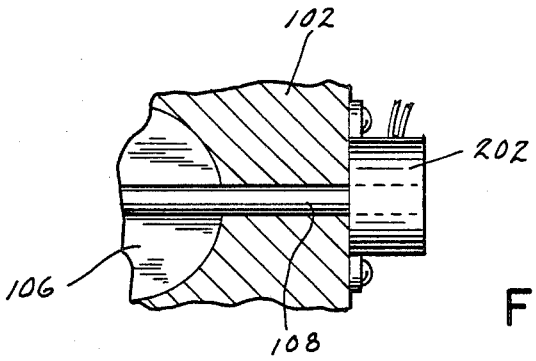

Upon further counterclockwise pivoting of lower lever arm 204, trunnion 210 drives connecting link 208 downwardly which in turn moves trunnion 212 downwardly, and hence pivots upper lever arm 206 counterclockwise to thus begin opening upper throttle valve plates 110, 112 against the bias of spring 228. FIGS. 6 and 9D shows this condition with both the lower and upper sets of throttle valves partially open, though the lower set of throttle valves are closer to the fully opened position. Continued counterclockwise pivoting of lower lever arm 204 drives connecting link 208 further downwardly to thus continue the pivoting of upper throttle valve plates 110, 112, and both the lower and upper sets of throttle valve plates reach the fully open position substantially simultaneously, FIGS. 7 and 9E. The length of upper lever arm 206 from pivot shaft 114 to trunnion 212 is shorter than the length of lower lever arm 204 from pivot shaft 108 to trunnion 210. Hence for a given length of motion of connecting link 208, upper throttle valve plates 110, 112 and pivot shaft 114 will pivot through a greater angle than lower throttle valve plates 104, 106 and lower pivot shaft 108. In this manner, the upper throttle valve plates 110, 112 pivot and open at a faster rate than the lower throttle valve plates 104, 106 in the sequence from FIGS. 5 through 7, and 9C through 9E.

Shut-off valve 224 is valve 50 in FIG. 2. Shut-off valve 224 is a Mercury Marine Part No. 2018348 and is mounted to manifold 102 and connected in puddled fuel return line 44 for recirculating heavy fuel ends from low points in the crankcase, as above described. Valve 224 has an inlet 230 connected to check valve 45, and an outlet 232 connected to vapor separator inlet **44*b*. Valve 224 has a plunger 234 which in its upward extended position provides an open valve condition such that inlet 230 communicates with outlet 232. When plunger 234 is in its downward retracted position, valve 224 is closed which blocks communication from inlet 230 to outlet 232. Valve 224 is internally biased to urge plunger 234 downwardly to the closed condition. Actuating arm 222 is pivoted about shaft 236 and includes a portion 238 engaging plunger 234 along the underside of a flat disc washer 239 fixed to plunger 234. Spring 240 biases actuating arm 222 clockwise such that portion 238 is biased downwardly away from washer 239 and hence plunger 234 is normally retracted downwardly to its closed position. Spring 218 overcomes the bias of spring 240 and the internal bias of valve 224 to bias lower lever arm 204 and auxiliary arm 220 to a clockwise pivoted position engaging actuating arm 222 to thus pivot the latter counterclockwise and pull plunger 234 upwardly to hence open valve 224 at idle and low engine speed. At high engine speed, lower lever arm 204 is pivoted counterclockwise and hence auxiliary arm 220 is pivoted away from actuating arm 222 whereby the latter pivots clockwise due to spring 240 to thus permit plunger 234 to move downwardly due to the internal bias of valve 224 and hence close valve 224** at high engine speed.

The shut-off valve is closed at high engine speed to prevent the flow at a high rate of a substantially gaseous medium to the vapor separator, to prevent fuel foaming otherwise caused thereby in the vapor separator and which would pass through the vapor vent line to the induction manifold, causing an over rich condition at high engine speed. At low engine speed, the shut-off valve is open, permitting flow of puddled fuel to the vapor separator, which flow is substantially more liquidic and at a lower rate.

It is recognized that various equivalents, alternatives and modifications are possible within the scope of the appended claims.

I claim:

1. A marine fuel system for a two cycle crankcase compression internal combustion engine having a piston reciprocal in a cylinder between a combustion chamber and a crankcase, an induction system supplying combustion air to the engine and fuel injection means mixing fuel with the combustion air, and having a fuel tank, said fuel system comprising fuel pump means connected to draw fuel from said fuel tank and supply fuel under pressure to said fuel injection means, pressure regulator means regulating the output pressure of said fuel pump means at said fuel injection means and returning excess fuel through an excess fuel return line to said fuel pump means for recirculation, a puddle removal system comprising a puddled fuel return line having an inlet connected to said crankcase and receiving puddled fuel including heavy fuel ends, and having an outlet connected to return puddled fuel to said fuel pump means for recirculation, wherein substantially all of the fluid flow in said puddled fuel return line from said crankcase is gaseous at high engine speed, and is more liquidic at low engine speed, a shut-off valve in said puddled fuel return line and having a closed condition at said high engine speed blocking said gaseous flow from said crankcase through said puddled fuel return line, and having an open condition at said low engine speed permitting fluid flow from said crankcase through said puddled fuel return line.

2. The invention according to claim 1 wherein said shut-off valve includes linkage means responsive to engine speed.

3. The invention according to claim 1 wherein said fuel pump means comprises a first fuel pump connected to draw fuel from said fuel tank and a second fuel pump connected to receive fuel from said first fuel pump and provide fuel under pressure to said fuel injection means, a vapor separator connected between said first and second fuel pumps to remove fuel vapors supplied to said second fuel pump, and wherein said excess fuel return line and said puddled fuel return line are connected to said vapor separator and comprising a vapor supply line connected between said vapor separator and said induction system to supply the vapor removed from said fuel to said induction system, and wherein said closed condition of said shut-off valve at high engine speed prevents said substantially gaseous flow otherwise present through said puddled fuel return line from causing foaming of fuel in said vapor separator, which foamed fuel may otherwise flow through said vapor supply line to said induction system causing an over-rich condition.

4. The invention according to claim 3 wherein said induction system includes a throttle controlling said combustion air, and operator controlled throttle linkage, and wherein said shut-off valve is also controlled by said operator controlled linkage.

* * * * *